US012635772B2

(12) United States Patent
Kicinski et al.

(10) Patent No.: US 12,635,772 B2
(45) Date of Patent: May 26, 2026

(54) BEADING TOOL

(71) Applicant: Gebr. Brasseler GmbH & Co. KG, Lemgo (DE)

(72) Inventors: Marcel Kicinski, Lemgo (DE); Thomas Pries, Lemgo (DE); Andreas Klassen, Lemgo (DE)

(73) Assignee: Gebr. Brasseler GmbH & Co. KG, Lemgo (DE)

( * ) Notice: Subject to any disclaimer, the term of this patent is extended or adjusted under 35 U.S.C. 154(b) by 0 days.

(21) Appl. No.: 18/755,501

(22) Filed: Jun. 26, 2024

(65) Prior Publication Data

US 2025/0024921 A1 Jan. 23, 2025

(30) Foreign Application Priority Data

Jul. 21, 2023 (DE) ..... 10 2023 119 340.6

(51) Int. Cl.
*A44C 17/04* (2006.01)

(52) U.S. Cl.
CPC ..... *A44C 17/043* (2013.01)

(58) Field of Classification Search
CPC .... A44C 17/043; A44C 17/046; B60D 1/141; A61B 17/3211; B23C 5/10; A47J 19/022; A61C 13/12
See application file for complete search history.

(56) References Cited

U.S. PATENT DOCUMENTS 816,997 A 4/1906 Pollard
3,766,809 A * 10/1973 Schneider ..... A44C 17/043 29/896.41
3,977,581 A * 8/1976 Franzson ..... A44C 17/043 D5/36
4,077,284 A 3/1978 Twichell
7,338,236 B2 * 3/2008 Rieke ..... B23C 5/10 407/53
11,576,696 B2 * 2/2023 Brause ..... A61B 17/3211
2009/0058043 A1 * 3/2009 Shannon ..... B60D 1/141 280/477

FOREIGN PATENT DOCUMENTS

DE 102011018989 A1 * 12/2011 ..... B02C 19/08
DE 102013011607 A1 * 1/2015 ..... A44C 17/043
FR 2773734 A1 * 7/1999 ..... A61C 13/12

OTHER PUBLICATIONS

Busch; DE-102013011607-A1 Machine Translation (Year: 2015).*
Thews; DE-102011018989-A1 Machine Translation (Year: 2011).*
Jeannin; FR-2773734-A1 Machine Translation (Year: 1999).*
European Patent Application No. 24179506.1, Extended European Search Report (Nov. 4, 2024).

* cited by examiner

*Primary Examiner* — Lee A Holly
(74) *Attorney, Agent, or Firm* — ICE MILLER LLP; Justin D. Swindells

(57) ABSTRACT

A beading tool for working retaining arms of pieces of jewelry comprises a cylindrical shank and a head. In this case, the head comprises a cylindrical portion and a transition portion. The shank and the head are arranged along a shared central axis. In this case, the external diameter of the shank is greater than the external diameter of the cylindrical portion. Furthermore, the cylindrical portion is arranged on a first end of the beading tool, wherein the transition portion is arranged between the cylindrical portion and the shank. The head comprises an indentation on its front face on the first end.

14 Claims, 3 Drawing Sheets

BEADING TOOL

CROSS-REFERENCE TO RELATED APPLICATIONS

This application claims benefit of priority to Germany Patent Application No. 10 2023 119 340.6 filed Jul. 21, 2023, the disclosure of which is incorporated herein by reference in its entirety.

BACKGROUND

The disclosure relates to a beading tool for working retaining arms of pieces of jewelry, and to an assembly comprising a rotary tool and a beading tool.

In the jewelry industry, gemstones, in particular diamonds, are retained by means of wire-shaped retaining arms made of precious metal, known as prongs, in a prong setting, e.g. in a ring. The prongs encompass the precious stone at regular intervals, for example in a three-prong, four-prong or six-prong setting, such that in particular light can fall onto the precious stone from the sides and the underside and a pleasing reflection of light is achieved, in particular in diamonds. In order not to block this light and to allow for a delicate appearance, the prongs sometimes have very fine structures. The individual prongs have to be bent after setting the stone in order to fix it in position. Up to this point, this has been done using beading tools, which have a thin tip comprising an indentation of which the diameter is adapted to the shape of the prongs. Previous beading tools, such as those described in DE 10 2013 01 1607 A1, comprise a conical tip. This means that there can be no regrinding of the tip since this would change its diameter and thus prevent precise working of the prongs. Furthermore, the conical tip restricts the view of the workpiece and its handling capability. Once the prongs are bent, they are often reground in another work step, for which purpose a hollow drill is used, for example. This material-removing finishing results in more material being required.

The object of the present disclosure is therefore that of providing a beading tool and an assembly comprising a rotary tool for working retaining arms of pieces of jewelry, which is easier to handle and has an improved service life while having a simple structure and being simple and cost-effective to produce. Furthermore, simplified and more rapid finishing of the retaining arms is to be made possible.

This object is achieved by means of a beading tool having the features of claim 1 and by means an assembly having the features of claim 14. The dependent claims disclose preferred embodiments.

In comparison, the beading tool according to the disclosure having the features of claim 1 has the advantage that the beading tool can be reground. Therefore, the service life of the beading tool can be improved and costs for new beading tools can be saved. Furthermore, a permanently sharp beading tool improves the worked quality of the retaining arms of the piece of jewelry. The beading tool according to the disclosure comprises a cylindrical shank and a head, which are arranged along a shared central axis. By means of the cylindrical shank, the beading tool can be clamped into a tool and rotatably operated. The head of the beading tool comprises a cylindrical portion, which is arranged on a first end of the beading tool, and a transition portion, which is arranged between the cylindrical portion and the shank. In this case, the cylindrical portion has a smaller external diameter than the shank of the beading tool. Furthermore, the head comprises a front-face indentation on the first end.

The first end thus forms the tip of the beading tool, by means of which retaining arms can be worked. The cylindrical portion allows the front-face indentation on the tip of the beading tool to be reground without the diameter of the cylindrical portion on the first end changing.

The transition portion preferably comprises a concave lateral surface. The concave lateral surface of the transition portion preferably tangentially abuts the cylindrical portion and curves away from the central axis. Therefore, the beading tool comprises a narrow head in the region of the first end, which makes the workpiece simple to work and improves the view thereof. The curvature, which increases towards the cylindrical shank, also allows for good mechanical properties of the beading tool.

More preferably, the indentation is conical. A conical indentation allows for precise working of the retaining arms due to its defined flanks.

Particularly preferably, a tip of the conical indentation is rounded. This allows the retaining arms to be worked in a smooth manner due to the fluid transition into the conical indentation.

More preferably, the opening angle of the conical indentation is between 100° and 130°, in particular between 115° and 125°. Particularly preferably, the opening angle of the conical indentation is 120°.

Preferably, the beading tool is configured to be clamped in a rotary tool. The geometry according to the disclosure allows the beading tool to be simultaneously used for shaping the retaining arms and for polishing the retaining arms, by the beading tool being rotated rapidly about the central axis of the beading tool by the rotary tool. Therefore, the tip of the retaining arm can be rounded and/or polished without being worked in a material-removing manner, meaning that loss of the material to be worked can be reduced. Since the material is often a precious metal, the production costs can thus be noticeably reduced, and this can contribute to a sustainable use of materials. The operation of the beading tool in a rotary tool is only possible owing to the cylindrical portion and the option to regrind the tip without changing the diameter of the tip, since the tool wear to the rotating beading tool is increased. The rotating beading tool also allows the prongs to be worked with a reduced application of force.

Preferably, the cylindrical portion has a length between 0.4 mm and 0.7 mm. In particular, the length of the cylindrical portion is 0.5 mm. This length allows the tip to be reground multiple times without the mechanical properties of the beading tool being diminished owing to an excessively long cylindrical portion.

More preferably, the head has a length of 3.2 mm and 6.7 mm. In this case, the length of the head increases as the diameter of the cylindrical portion decreases. Therefore, a smooth transition between the cylindrical shank and the cylindrical portion of the head can be made possible.

Preferably, the length of the beading tool is 40 mm to 50 mm. Owing to this comparatively short length of the beading tool, the distance which the jeweler has to cover with their wrist when working the retaining arms is minimized. Therefore, the length of the beading tool of between 40 mm and 50 mm allows the beading tool to be handled in a comfortable manner that is gentle on the joints.

The shank of the beading tool preferably has an external diameter between 2 mm and 2.6 mm. In particular, the external diameter of the shank is 2.35 mm, and therefore it can be arranged in a 104-HP receptacle of a rotary tool.

The ratio of the external diameter of the cylindrical portion to the external diameter of the shank is preferably between 0.16 and 0.6. Therefore, the cylindrical portion having the indentation in the region according to the disclosure allows very fine, wire-shaped retaining arms right through to larger retaining arms to be worked.

The ratio of the external diameter of the cylindrical portion to the diameter of the indentation is preferably between 1.03 and 1.2. The diameter of the indentation is defined in a plane on the front face on the first end of the beading tool. Owing to the ratio according to the disclosure, the beading tool comprises a thin edge region on the tip between the cylindrical portion and the indentation. The thin edge region allows the retaining arms to be worked in a precise manner.

The beading tool is preferably made of carbide metal or stainless steel.

Furthermore, an assembly for working retaining arms of pieces of jewelry is claimed according to claim 13. The assembly comprises a beading tool, as described above, and a rotary tool. In this case, the shank of the beading tool is arranged in a tool mount of the rotary tool. The assembly according to the disclosure thus both allows retaining arms of pieces of jewelry to be worked in a shaping manner and allows the retaining arms to be polished, by the beading tool being rotated rapidly about the central axis of the beading tool by the rotary tool.

BRIEF DESCRIPTION OF THE DRAWINGS

Further details, advantages and features of the present disclosure will become clear from the following description of exemplary embodiments with reference to the drawings, in which.

DETAILED DESCRIPTION

Figure 1:
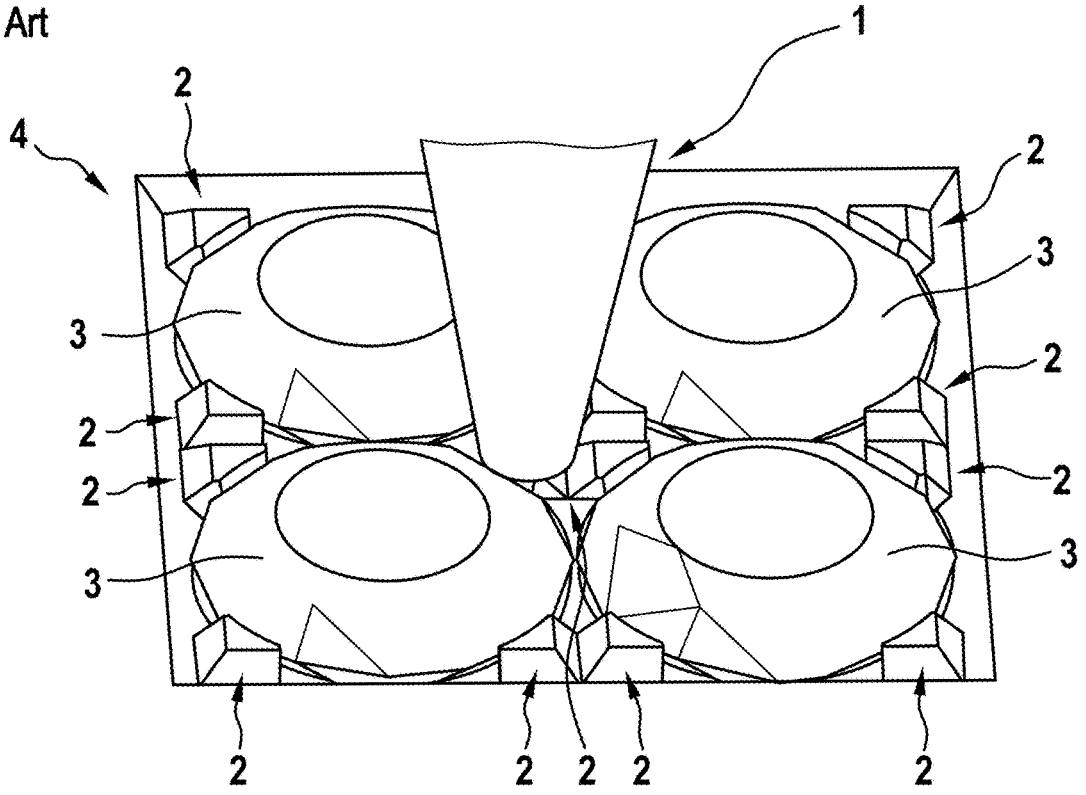
Fig. 1 Prior Art
FIG. 1 is a schematic view of a beading tool for working retaining arms according to the prior art.

FIG. 1 shows a beading tool 1 according to the prior art, which is used to shape retaining arms 2 of a piece of jewelry 4. By shaping the retaining arms 2, stones 3 or other objects can be fixed in position on the piece of jewelry 4. FIG. 1 shows a detail of a piece of jewelry 4, which shows four cut gemstones 3 in a setting. Around each stone 3, four retaining arms 2 are arranged, which, in the initial state, allow the stones 3 to be inserted into the piece of jewelry 4. After being inserted, the retaining arms 2 can be shaped towards the stones 3 by means of the beading tool 1 in order to fix the stones 3 in position. The retaining arms 2 can, as in FIG. 1 and FIG. 2, be in the shape of a polyhedron or can be wire-shaped, for example. The retaining arms preferably consist of the base material of the piece of jewelry 4, which is in particular a precious metal such as silver, gold or platinum. The diameter of the tip of the beading tool 1 is preferably adapted to the size and shape of the retaining arms 2. After the shaping process using the beading tool 1, the retaining arms 2 can be finished in a work step, e.g. rounded and polished.

The beading tool 1 according to the prior art comprises a conical head, which continuously widens from a tip to a shank. Because the tip immediately widens, it obscures the view of two retaining arms 2 in FIG. 1. Furthermore, when the tip of the beading tool 1 according to the prior art is worn, it is not possible to regrind the beading tool 1.

In the following, with reference to FIG. 2 to FIG. 4, a beading tool 1 according to a preferred exemplary embodiment is described in detail.

Figure 2:
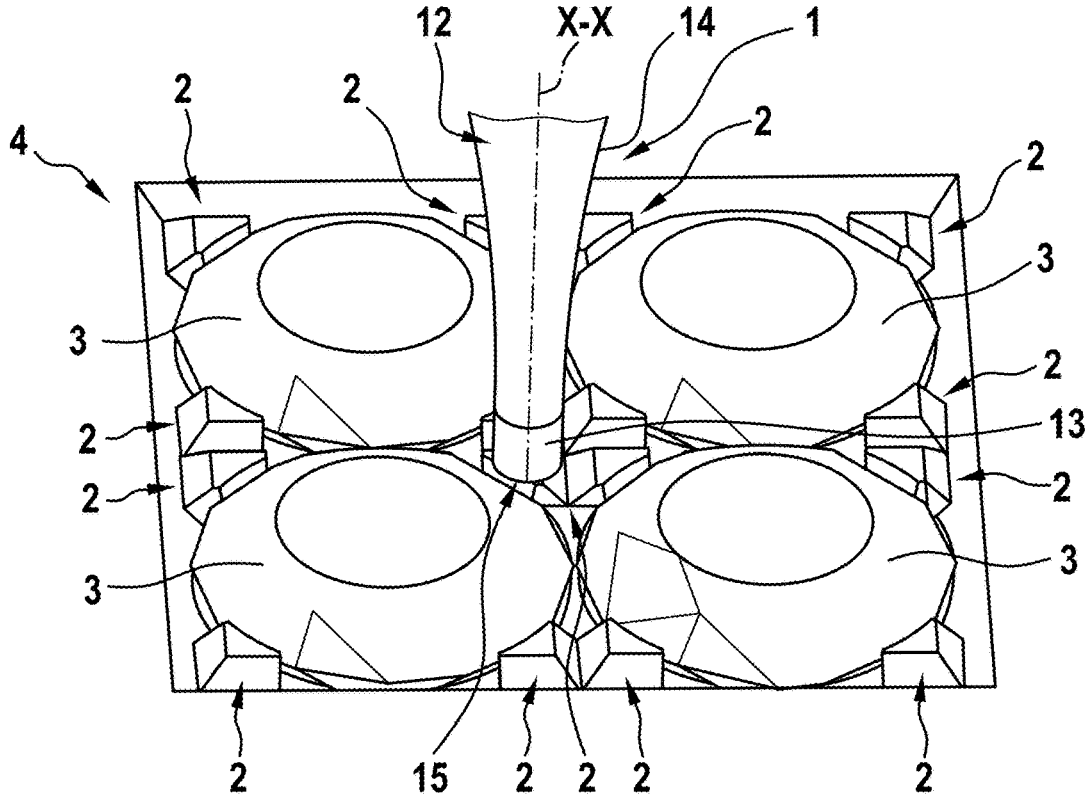
FIG. 2 is a schematic view of a beading tool for working retaining arms according to a preferred embodiment.

FIG. 2 shows the piece of jewelry 4 from FIG. 1 with four stones 3, which are each surrounded by four retaining arms 2. Instead of the beading tool 1 according to the prior art, FIG. 2 shows a head 12 of the beading tool 1 according to the disclosure.

By contrast with the beading tool 1 according to the prior art, which comprises a conical head 12, the claimed head 12 of the beading tool comprises a cylindrical portion 13 and a transition portion 14. Therefore, the head 12 of the beading tool 1 can be configured to be narrower in the region of a first end 15, meaning that the view of the piece of jewelry 4 to be worked is improved. The cylindrical portion 13 allows the beading tool 1 to be reground when it is blunt.

The lateral surface of the transition portion 14 is curved in a concave manner towards a central axis X-X. In this case, the lateral surface of the transition portion 14 tangentially abuts the lateral surface of the cylindrical portion 13 such that the cylindrical portion 13 fluidly transitions into the transition portion 14.

Figure 3:
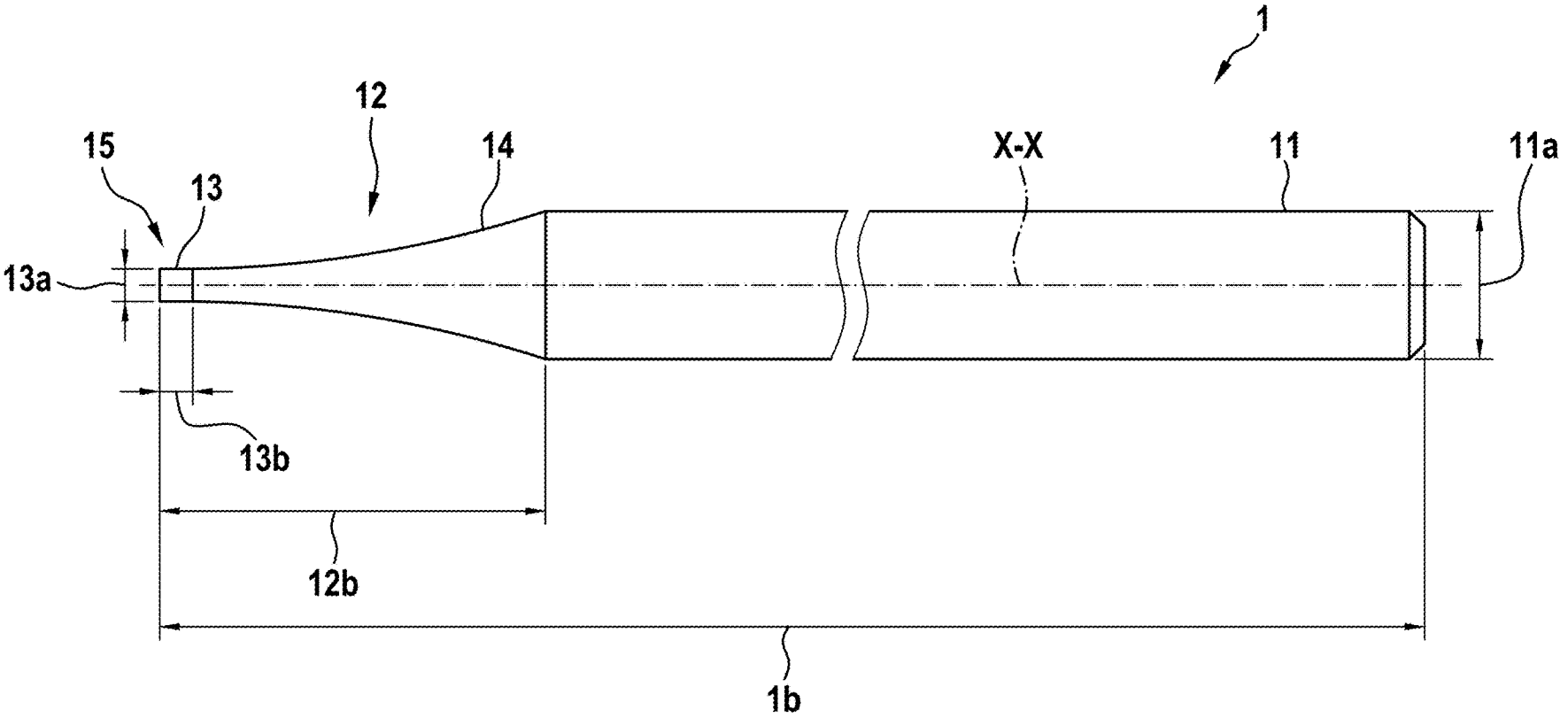
FIG. 3 is a schematic side view of the beading tool according to the preferred embodiment.

FIG. 3 is a schematic side view of the entire beading tool 1 according to the preferred embodiment. A cylindrical shank 11 adjoins the head 12 of the beading tool 1. The shank 11 and the head 12 are arranged along a shared central axis X-X. In this case, the shank 11 of the beading tool 1 is shown in FIG. 3 as being shortened.

An external diameter 13*a* of the cylindrical portion 13 is preferably 0.1 to 0.6 times smaller than an external diameter 11*a* of the shank 11. In the exemplary embodiment shown, the length 13*b* of the cylindrical portion is 0.5 mm. In this case, the shank 11 of the beading tool 1 is preferably configured as a 104-HP shank having an external diameter 11*a* of 2.35 mm, such that the beading tool 1 can be clamped into a rotary tool. The shank is preferably rotated and has an average surface roughness Rz of 4 μm.

Clamping the beading tool 1 into a rotary tool allows the beading tool 1 to be used regularly for shaping the retaining arms 2 using the rotary tool as a handpiece. In addition, the claimed shape of the beading tool 1 makes it possible to later round and/or polish the retaining arms 2 by the beading tool 1 being set into a rotating movement about its central axis X-X by means of the rotary tool. With a rotating beading tool, this is possible with a reduced application of force.

The beading tool 1 is preferably made of a tool steel for cold working, such as the material DIN/EN-1.2516, which is characterized by high wear resistance and hardness. The tool steel is preferably hardened and annealed, and has a Vickers hardness of 810+30 HV. Alternatively, the beading tool 1 can be made of carbide metal.

The beading tool 1 preferably has a length 1*b* of 40 mm to 50 mm. Owing to this comparatively short length 1*b*, the distance which the jeweler has to cover with their wrist when working the retaining arms 2 can be minimized, resulting in the beading tool being able to be handled in a more comfortable manner that is gentle on the joints.

The head 12 of the beading tool 1 preferably has a length 12*b* between 3.2 mm and 6.7 mm and is preferably dependent on the external diameter 13*a* of the cylindrical portion 13. The smaller the external diameter 13*a* of the cylindrical portion 13, the longer the length 12*b* of the head 12.

Figure 4:
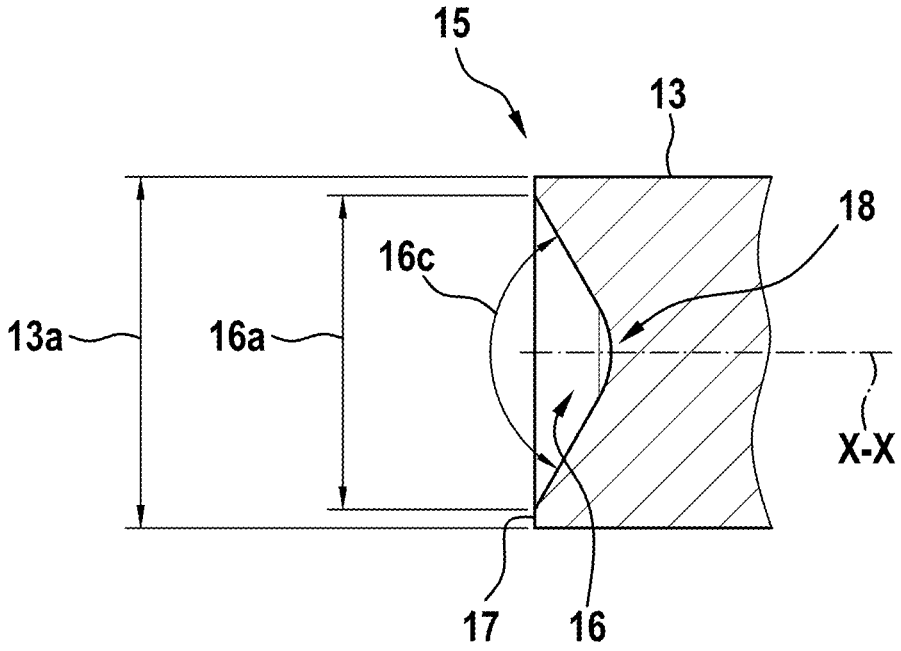
FIG. 4 is a schematic detailed side view of the tip of the beading tool according to the preferred embodiment.

FIG. 4 shows an enlarged sectional view of the beading tool 1 from FIG. 3 in the region of the first end 15. In this case, an indentation 16 is made in the cylindrical portion 13 on its front face on the first end 15.

The indentation 16 is conical, with a tip 18 of the conical indentation 16 being rounded. The tip 18 of the indentation 16 is preferably arranged on the central line X-X. The tip 18 transitions continuously into the conical indentation 16.

The opening angle 16*c* between the opposite regions of the conical indentation 16 is preferably 120°.

There is preferably a narrow annular edge region 17 between a maximum diameter 16*a* of the indentation 16 and the external diameter 13*a* of the cylindrical portion 13. The width of the edge region 17 is defined by the ratio between the diameter 16*a* of the indentation 16 and the external diameter 13*a* of the cylindrical portion 13. In this case, the external diameter 13*a* of the cylindrical portion 13 is preferably 1.03 to 0.2 times greater than the maximum diameter 16*a* of the indentation 16, such that the resulting narrow edge region 17 allows for precise working of the retaining arms 2 without slipping off.

In addition to the above written description, in order to provide supplementary disclosure reference is hereby explicitly made to the drawings in the figures.

LIST OF REFERENCE NUMBERS

1 Beading tool
1*b* Length of the beading tool
2 Retaining arm
3 Stone
4 Piece of jewelry
11 Cylindrical shank
11*a* External diameter of the shank
12 Head
12*b* Length of the head
13 Cylindrical portion
13*a* External diameter of the cylindrical portion
13*b* Length of the cylindrical portion
14 Transition portion
15 First end
16 Indentation
16*a* Diameter of the indentation
16*c* Opening angle
17 Edge region
18 Tip of an indentation
X-X Central axis

What is claimed is:

1. Beading tool for working retaining arms of pieces of jewelry, comprising:

a cylindrical shank and a head, which comprises a cylindrical portion and a transition portion, wherein the shank and the head are arranged along a shared central axis, wherein the external diameter of the shank is greater than the external diameter of the cylindrical portion, wherein the cylindrical portion is arranged on a first end of the beading tool, wherein the transition portion is arranged between the cylindrical portion and the shank, wherein the head has an indentation on the head's front face on the first end, and wherein a lateral surface of the transition portion tangentially abuts a lateral surface of the cylindrical portion such that the cylindrical portion fluidly transitions to the transition portion.

2. Beading tool according to claim 1, wherein the indentation is conical.

3. Beading tool according to claim 2, wherein a tip of the conical indentation is rounded.

4. Beading tool according to claim 2, wherein the opening angle of the conical indentation is between 100° and 130°.

5. Beading tool according to claim 1, wherein the transition portion comprises a concave lateral surface.

6. Beading tool according to claim 1, wherein the beading tool is configured to be clamped in a rotary tool.

7. Beading tool according to claim 1, wherein the cylindrical portion has a length between 0.4 mm and 0.7 mm.

8. Beading tool according to claim 1, wherein the head has a length between 3.2 mm and 6.7 mm.

9. Beading tool according to claim 1, wherein the beading tool has a length between 40 mm and 50 mm.

10. Beading tool according to claim 1, wherein the shank has an external diameter between 2 mm and 2.5 mm.

11. Beading tool according to claim 1, wherein the ratio of an external diameter of the cylindrical portion to the external diameter of the shank is between 0.16 and 0.6.

12. Beading tool according to claim 1, wherein the ratio of the external diameter of the cylindrical portion to a diameter of the indentation is between 1.03 and 1.2.

13. Beading tool according to claim 1, wherein the beading tool is made of carbide metal.

14. Assembly for working retaining arms of pieces of jewelry, comprising:

a beading tool according to claim 1, and a rotary tool, wherein a shank of the beading tool is arranged in a tool mount of the rotary tool.

* * * * *